United States Patent [19]

Off

[11] Patent Number: 4,803,935

[45] Date of Patent: Feb. 14, 1989

[54] BELTLOOP FORMING AND TRANSFER METHOD AND APPARATUS

[75] Inventor: Joseph W. A. Off, Irving, Tex.

[73] Assignee: Automated Machinery Systems, Inc., Richmond, Va.

[21] Appl. No.: 90,542

[22] Filed: Aug. 28, 1987

[51] Int. Cl.[4] ..... D05B 3/12; D05B 35/00

[52] U.S. Cl. ..... 112/121.27; 112/104

[58] Field of Search ..... 112/104, 121.27, 121.26, 112/152, 130, 147

[56] References Cited

U.S. PATENT DOCUMENTS

| | | | |
|---|---|---|---|
| 3,792,672 | 2/1974 | Friedman et al. | 112/104 |
| 3,841,247 | 10/1974 | Off et al. | 112/121.27 |
| 4,114,544 | 9/1978 | Miyachi et al. | 112/121.27 X |
| 4,393,800 | 7/1983 | Hargett | 112/104 X |
| 4,502,399 | 3/1985 | Seaman | 112/121.27 |
| 4,527,491 | 7/1985 | Block et al. | 112/104 |
| 4,561,365 | 12/1985 | Schmidt et al. | 112/121.27 |
| 4,561,366 | 12/1985 | Schmidt et al. | 112/104 X |

*Primary Examiner*—H. Hampton Hunter

*Attorney, Agent, or Firm*—Bacon & Thomas

[57] ABSTRACT

A method and apparatus for forming belt loops and transferring the formed loop to a sewing station where the loop may be stitched to the waistband of a pair of trousers. The invention is particularly useful in sewing belt loops onto the waistbands of trousers of the blue jeans type.

12 Claims, 10 Drawing Sheets

376
386
384
374
394a
390
396
290
296
292
298
312
304
286a
286b
120
134
150
136
138
132
126
10
12
20
26
22
306
324
323
322
312
310
300
30
40
14
16
67
66
64
62
60
58
56
54
53b
76
57
55
50
53a
36

FIG 4
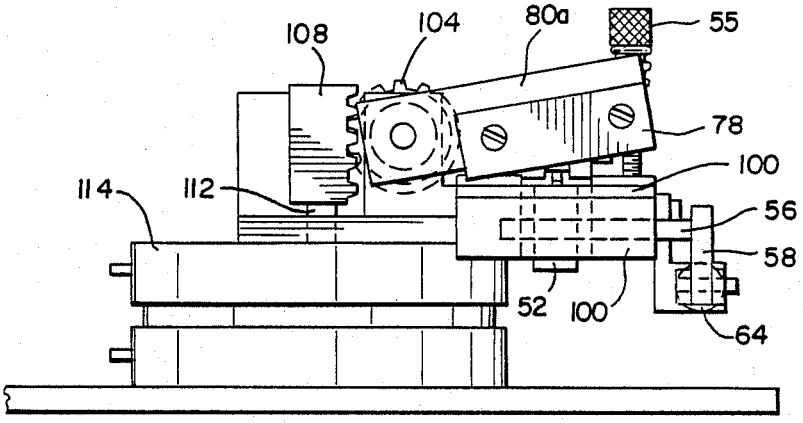
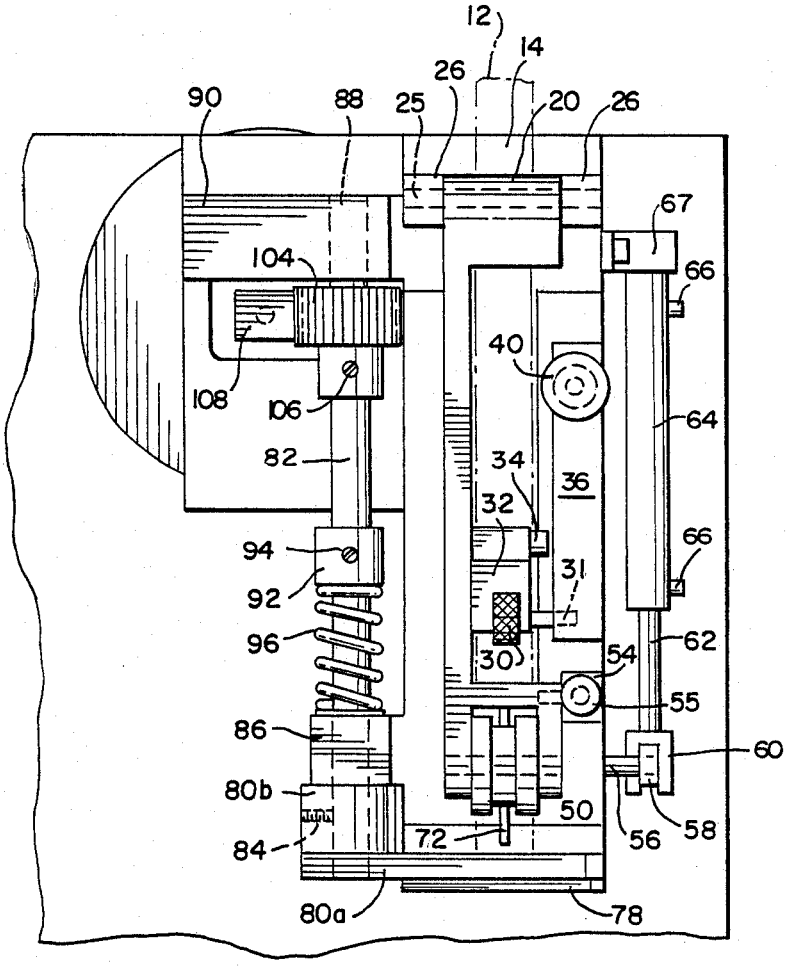
FIG 5

BELTLOOP FORMING AND TRANSFER METHOD AND APPARATUS

This invention relates to a method and apparatus for forming belt loops and transferring the formed loop to a sewing station where the loop may be stitched to the waistband of a pair of trousers. The invention is particularly useful in sewing belt loops onto the waistbands of trousers of the blue jeans type.

BACKGROUND OF THE INVENTION

Forming belt loops and attaching them to the waistband of a pair of trousers is a complex and labor intensive task if performed by hand. For this reason, there has been great interest in automating this operation as much as possible. Apparatus is known for automatically forming belt loops and feeding them to the waistband of a pair of blue jeans, for example. Although various types of this apparatus have been used commercially, they have not been entirely satisfactory. One problem that has arisen with the use of known types of beltloop forming and feeding apparatus is that the folded-under part at the ends of the length of beltloop material are longer than desired. After stitching the beltloop to the trousers, the free ends extend considerably beyond the stitching. It presently is common practice to pre-wash or stone-wash the jeans after completion, but before shipping from the factory. This washing process, and subsequent washings by the wearer, cause the free ends of the belt loops to become floppy and frayed. This is unsightly and undesirable in the very competitive jeans market where the appearance of quality is important.

To overcome the fraying of the beltloop ends, various different approaches have been tried, all requiring additional handling, additional equipment, and further expense. For example, one solution has been to manually cut off the extra lengths at the ends of the stitched beltloop. Some manufacturers dip the beltloop ends in a plastic substance that cures to prevent the ends from fraying. Other manufacturers have included a plastic material in the beltloop material. When the material is cut to desired lengths with a hot knife, the plastic melts in such a manner as to "seal" the ends to prevent fraying. Others have used a special knife that cuts the beltloop ends on the bias in such a manner as to minimize fraying.

An additional problem has arisen in finished jeans because of the way in which the folded-under ends of the belt loops have been formed. Known apparatus for forming the folded-under ends includes two spaced fingers that receive a beltloop end therebetween. One finger is rotated about the other, and in doing so, bends the beltloop material around the stationary finger. Not only does this operation form a folded-under end that is longer than necessary, but it has a tendency to stretch the beltloop material in the direction of its length. Even after stitching of the beltloop to the waistband, the cloth remains in its stretched condition. After washing, the formerly stretched material tends to bulge outwardly and the belt loops will not lie flat against the waistband. This is unsightly and detracts from the image of a quality product.

The apparatus and method of this invention overcome the problems mentioned above by automatically forming and feeding beltloops having shorter folded-under ends that are closely adjacent the stitching. In the prior art beltloop folding apparatus, the folded-under ends ranged in length from 7/16 to ½ inch. With my invention, I am able to form belt loops with only approximately ¼ inch folded-under ends This substantially eliminates the problem of elongated frayed ends of the belt loops. Furthermore, when it is considered that each pair of jeans has seven belt loops, and approximately 450 million pairs of jeans were manufactured this past year, the amount of cloth that can be saved by the use of this invention is substantial.

BRIEF DESCRIPTION OF THE DRAWINGS

The invention will be described by referring to the accompanying drawing wherein:

FIGS. 4 and 5 are, respectively, simplified end and top views of the beltloop material feeding mechanism and knife mechanism that is part of the apparatus of FIG. 1;

DESCRIPTION OF PREFERRED EMBODIMENT

In the following description, and in the claims, the term "beltloop material" is used. By this term I mean a continuous strip of beltloop that is finished except for cutting to a desired length and forming the folded-under ends prior to stitching onto a waistband. As is known in the art, the continuous strip is formed by splicing together shorter lengths of the beltloop material.

Figure 2:
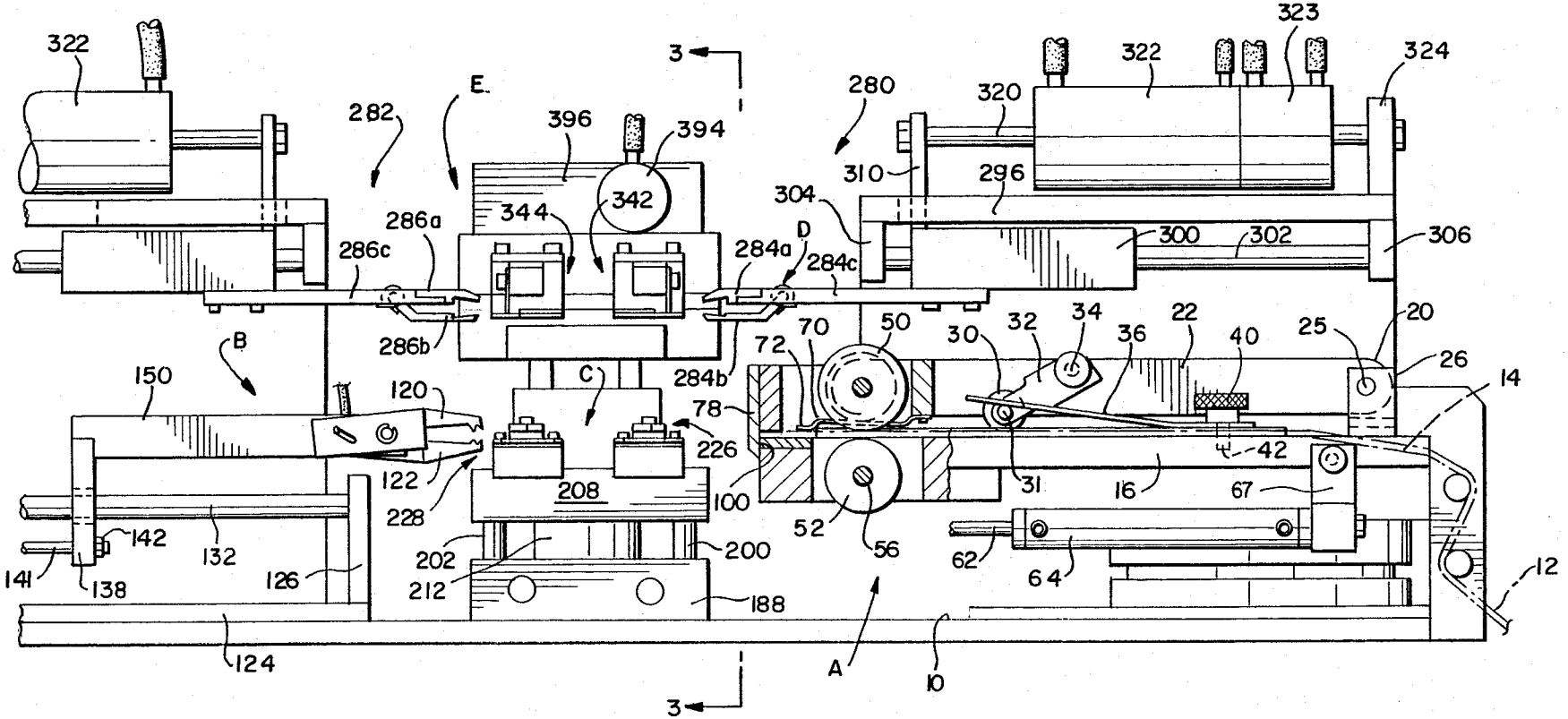
FIGS. 2 and 3 are, respectively, simplified front and side illustrations of the apparatus of FIG. 1.

In order to better understand the detailed description that follows, a brief summary of the overall operation of the apparatus of this invention first will be given. Referring to FIG. 2 for this preliminary summary, a beltloop feeder and cutoff subassembly A feeds about ⅜ inch of material toward the open central region of the figure and the puller subassembly B grabs the free end and pulls it out to the left a predetermined distance. The pulled-out beltloop material is clamped by two clamps of the transfer clamps subassembly C and the puller releases the free end. Knife blade 78 of the feeder and cutoff subassembly A cuts off the pulled-out beltloop material to a desired length. The transfer clamps subassembly C then raises up and causes the two loop formers D to fold the free ends of the beltloop under the remainder of the beltloop. Feeder clamps subassembly E picks up the folded beltloop from the loop formers D and feeds it to the sewing station at an adjacent sewing machine.

Figure 1:
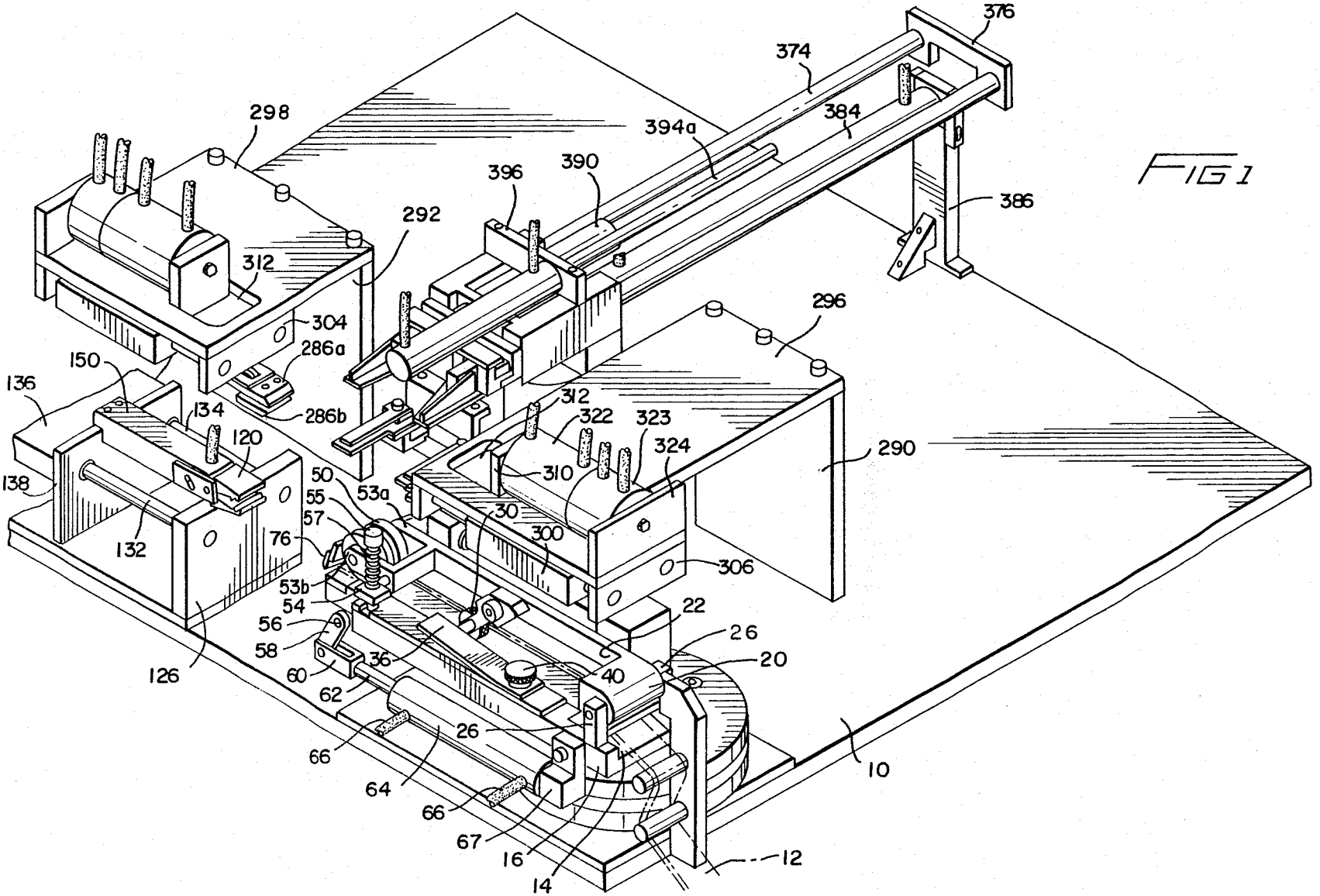
FIG. 1 is a simplified perspective illustration of the beltloop forming and feeding apparatus of this invention.

Continuing now with a detailed description of the various subassemblies of the apparatus of this invention, the various subassembles are mounted on a horizontally extending the base 10. Beltloop material is supplied in a continuous strip that is wound on a reel which is mounted near the bottom of the apparatus, but which is not illustrated in the drawings. As seen in FIGS. 1, 2, and 5, the beltloop material enters the feed and cutoff subassembly A between a ramp 14 on the right end of the subassembly base plate 16 and the hinged end 20 of swing arm 22. The right end of the swing arm pivots on a pivot pin 25 that is supported between the spaced posts 26 that extend upwardly from base plate 16. The beltloop material passes horizontally across the midregion of base plate 16 and under a knurled idler wheel 30 which has single direction roller clutch. As best seen in FIG. 2, knurled wheel 30 is rotatably mounted in bracket 32 by means of axle 31 and the bracket 32 in turn is mounted for free pivotal movement on a pivot pin 34. The right end of leaf spring 36 is fixed to base plate 16 by means of knob 40 that has a stem 42 threaded into base 16. The left end of the spring rides on top of axle 31 and resiliently holds knurled wheel 30 in contact with beltloop material 12.

Beltloop material 12 continues to the left end of base plate 16 and passes between upper grooved idler wheel 50 and driven knurled wheel 52. Grooved wheel 50 is rotatably mounted between the tines 53*a* and 53*b* of the forked end of swing arm 22. Driven knurled wheel 52 is mounted on a one-way clutch that permits rotation of wheel 52 in the counterclockwise direction, FIG. 2, but prevents rotation of the wheel in the opposite direction. A suitable one-way clutch is sold under the trademark SURE-LOCK roller clutch, part number NRC-4, by Winfred M. Berg, Inc., East Rockaway, N.Y. This same clutch may be used for idler wheel 30.

Grooved wheel 50 is resiliently held in contact with the top surface of the beltloop material by means of an arrangement that includes an apertured block 54 that is attached to the rear of fork tine 53*b*. A threaded bolt 55 passes freely through block 54 and is threaded into base plate 16. Bolt 55 retains a helical compression spring 57 between the head of the bolt and the block 54 to resiliently urge the block 54, and thus grooved wheel 50, downwardly.

As best seen in FIGS. 1 and 5, driven axle 56 of knurled wheel 52 is fixedly secured in one end of crank arm 58 and thus is rotated by the crank arm. The opposite end of crank arm 58 is pivotally connected to the fork or clevis 60 that is connected to the end of piston rod 62 of pneumatic cylinder 64. The conventional fluid ports of the cylinder are represented at 66. The right end of cylinder 64 is secured to base plate 16 by a bracket 67.

When rod 62 is withdrawn into cylinder 64, crank arm 58 rotates in the counterclockwise direction and causes driven wheel 52 to rotate in that same direction. The extension of piston rod 62 of cylinder 64 causes crank arm 58 and axle 56 to rotate in the clockwise direction. Because of the one-way clutch on which driven wheel 52 is mounted, wheel 52 does not rotate in the clockwise direction. Because the beltloop material is held between grooved idler wheel 50 and knurled driven wheel 52, the rotation of knurled wheel 52 causes the beltloop material to advance to the left each time piston rod 62 is retracted into cylinder 64.

In practice, cylinder 64 is a double-acting pneumatic cylinder whose timed operation is under control of a programmable control system that may be any one of a plurality of known programmable controllers. I have used a controller known as a Melsec F2-60M, Model F2-60 M2-U, sold by Mitsubishi Electric Corporation, Tokyo, Japan.

The programming and the operation of the control system are conventional and known in the art. Accordingly, because the control system, per se, is not the subject of my invention, I will not describe it in detail except to mention that the steps of the program are usually performed in response to signals that are produced from position sensors or "pick off" devices of known types, such as Hall effect devices and permanent magnets, on relatively moving parts, or reed switches and permanent magnets on relatively moving parts. Also, some programmed steps are produced after a timed delay following a position sensor output signal. Suitable support means may be required to position the position sensor means at desired locations on and/or adjacent the moving parts.

As best seen in FIG. 2, another leaf spring 70 has its right end secured to the back of the forked end of swing arm 22. The spring extends to the left through the reduced diameter portion of grooved wheel 50 and terminates in a downwardly depending foot portion 72 that resiliently contacts the top surface of the beltloop material to hold it flat and straight as the material approaches the cutoff knife blade 78.

Referring now to FIGS. 4 and 5, knife blade 78 is attached to mounting bar 80*a* by means of screws so that it may be removed for sharpening of replacement. Mounting bar 80*a* includes a thick, apertured end 80*b* that receives the end of knife shaft 82. Mounting bar 80*a* and its end 80*b* are secured to and rotate with knife shaft 82 by means of set screw 84. Knife shaft 82 is rotatably supported in bushing block 86 that is adjacent the end 80*b* of the knife mounting block, and the opposite end 88 of knife shaft 82 is rotatably received in a bushing block 90. Bushing block 86 is secured to the base plate 16 of the knife assembly. Collar 92 is secured intermediate the ends of knife shaft 82 by means of set screw 94. Helical spring 96 is coaxial about knife shaft 82 and is retained in compression between collar 92 and the end face of bushing block 86. This arrangement of helical spring 96 urges knife shaft 82 toward the rear of the feed and cutoff subassembly A to bring knife blade 78 into close shearing relationship with the shearing edge 100, FIG. 2.

A pinion gear 104 is secured to knife shaft 82 by means of set screw 106 that is in the hub of the gear. Pinion gear 104 is in engagement with rack 108, FIG. 4, which is attached to the end of a piston shaft 112 that is reciprocated up and down by means of the large flat pneumatic cylinder 114. The actuation of cylinder 114 will raise and lower rack 108 to cause rotation of pinion 104 and knife shaft 82. This motion causes knife blade 78 to come down across the shearing edge 100, FIG. 2, to cut a piece of beltloop material 12 that is extending beyond the shearing edge. Pneumatic cylinder 114 is actuated in its programmed sequence by the programmed controller mentioned above.

As will be explained in more detail below, during the operation of the apparatus of this invention, knife blade 78 cuts beltloop material 12 so that the material's end is at the shearing edge 100, FIG. 2. Cylinder 64 is actuated to cause driven knurled wheel 52 to rotate a given amount to cause a length of approximately $\frac{3}{8}$ inch of beltloop material to advance beyond the shearing edge 100. A beltloop puller mechanism B that includes a pair of puller jaws 120,122, FIGS. 1,2, and 6, clamp onto the free end of the beltloop material and pull out a desired length of the material from the feed and cutoff subassembly A. The puller subassembly B includes a mounting base 124 to which upstanding end plates 126, 128 are secured. A pair of spaced slide rails 132, 134 are mounted between the end plates, and a slide assembly comprised of horizontal and vertical blocks 136, 138, respectively, are mounted on the slide rails by means of suitable bushings. A pneumatic cylinder 140 having a piston rod 141 is mounted between end block 128 and vertical block 138. The end of piston rod 141 is secured to block 138 by any suitable means that may include a nut 142, so that when the piston rod is translated horizontally in and out of the cylinder 140 the slide assembly comprised of blocks 136 and 138 is translated back and forth on slide rails 132, 134.

Figure 6:
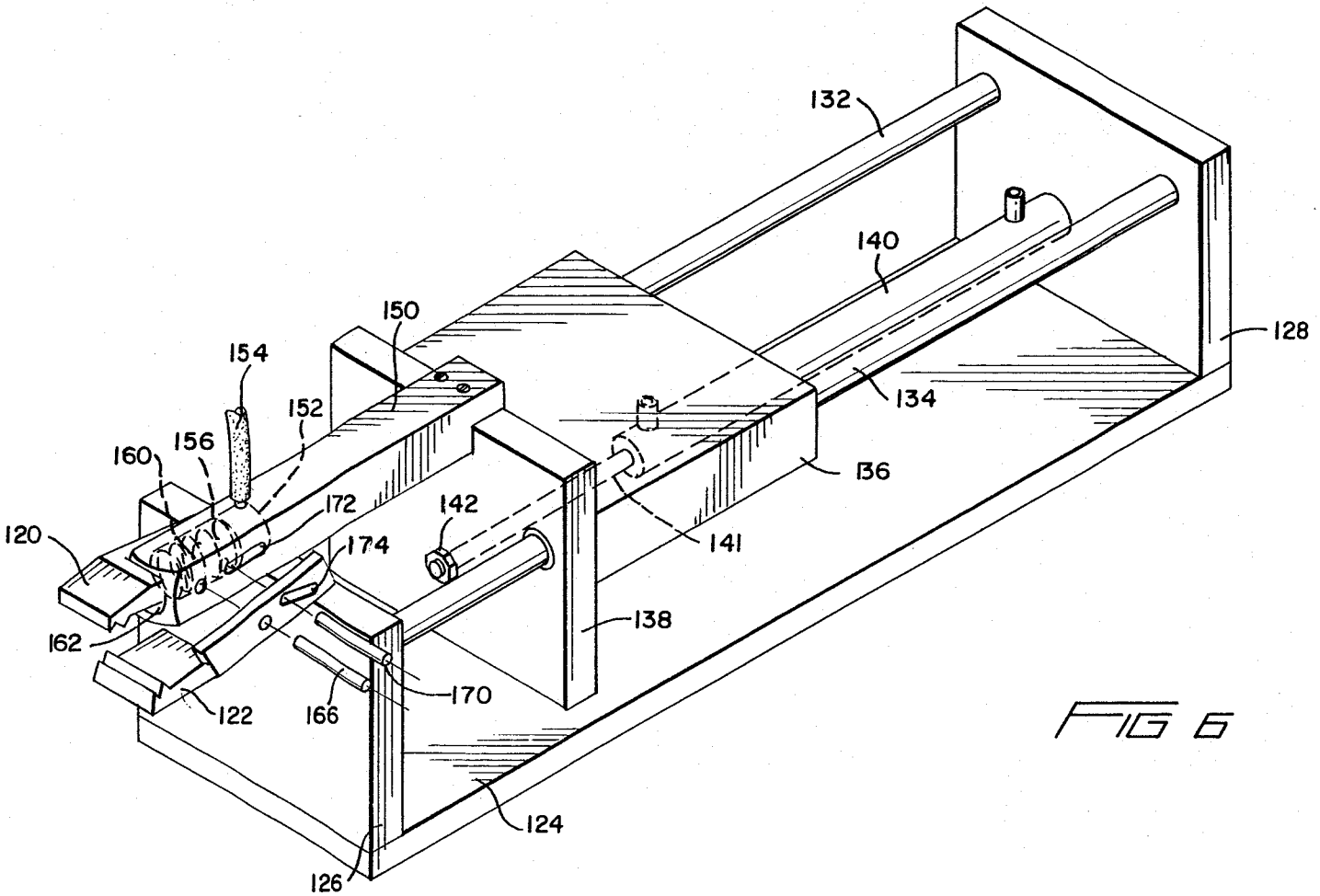
FIG. 6 is a simplified illustration of the puller clamp assembly that pulls out a desired length of beltloop material from a continuous supply of the material.

A puller bar 150 is secured to slide block 138 by suitable means, and puller jaws 120, 122 are attached to the outer end of bar 15. As illustrated in FIG. 6, the left end of puller bar 150 has a central bore therein which includes a pneumatic cylinder having an air input line 154 connected at its right end. A piston 156 is disposed in cylinder 152 and is urged toward the right, or inner, end of the cylinder by a compression spring 160. An end cap 162 closes the end of bore 152.

Upper and lower puller jaws 120, 122 are pivotally attached to puller bar 150 by means of a pivot pin 166 that passes through respective apertures in the lever arms of the jaws and through apertures in opposite side walls of the puller bar. A push rod 170 is carried by piston 156 and extends through side slots 172 on both sides of the cylinder body. The opposite ends of push rod 170 are received in respective oppositely inclined slots on the back parts of the lever arms of the two jaws 120, 122. Spring 160 urges piston 156 toward the right so that push rod 170 normally is at the far end of inclined slot 174 in lower jaw 122. This causes lower jaw 122 to pivot about pivot pin 166 in the counterclockwise direction in FIG. 6 to hold jaw 122 in its open position. The slot in upper jaw 120 corresponding to slot 174 is inclined transversly to slot 174 so that push rod 170 causes top jaw 120 to rotate in the clockwise direction when piston 156 and push rod 170 are at their far right positions.

When air is forced into the right end of cylinder 152, piston 156 is translated to the left in FIG. 6, and push rod 170 moves toward the front of inclined slot 174 in the lever arm of bottom jaw 122. This causes bottom jaw 122 to rotate in the clockwise direction about pivot pin 166 to close bottom jaw 122 on the bottom of a beltloop. Because the slot in the lever arm of top jaw 120 is inclined oppositely to slot 174, top jaw 120 pivots in the counterclockwise direction to close toward the lower jaw 122. When increased air pressure on the right side of piston 156 is terminated, spring 160 returns piston 156 to the right end of cylinder 152 and push rod 70 moves to the back ends of the respective slots, and the two jaws open in opposite directions.

In the operation of the puller subassembly B, pneumatic cylinder 140 is actuated at the proper time by the above-mentioned programmed controller and the slide assembly comprised of slide blocks 136, 138 is moved to the right in FIG. 1 to place the open jaws 120,122 over the free end of a piece of beltloop material 12 that is extending beyond the shearing edge 100. Piston 156 in the end of puller rod 150 then is translated toward the outer end of the cylinder to cause jaws 120,122 to close and grip the free end of the beltloop material. With jaws 120, 122 clamped to the free end of the beltloop material 12, cylinder 140 in the puller subassembly is actuated by the control system to retract piston rod 141 within the cylinder and thereby pull the closed jaws 120, 122 away from the feeder and cutoff subassembly A a predetermined distance so that a desired length of beltloop material is beyond knife blade 78.

Figure 3:
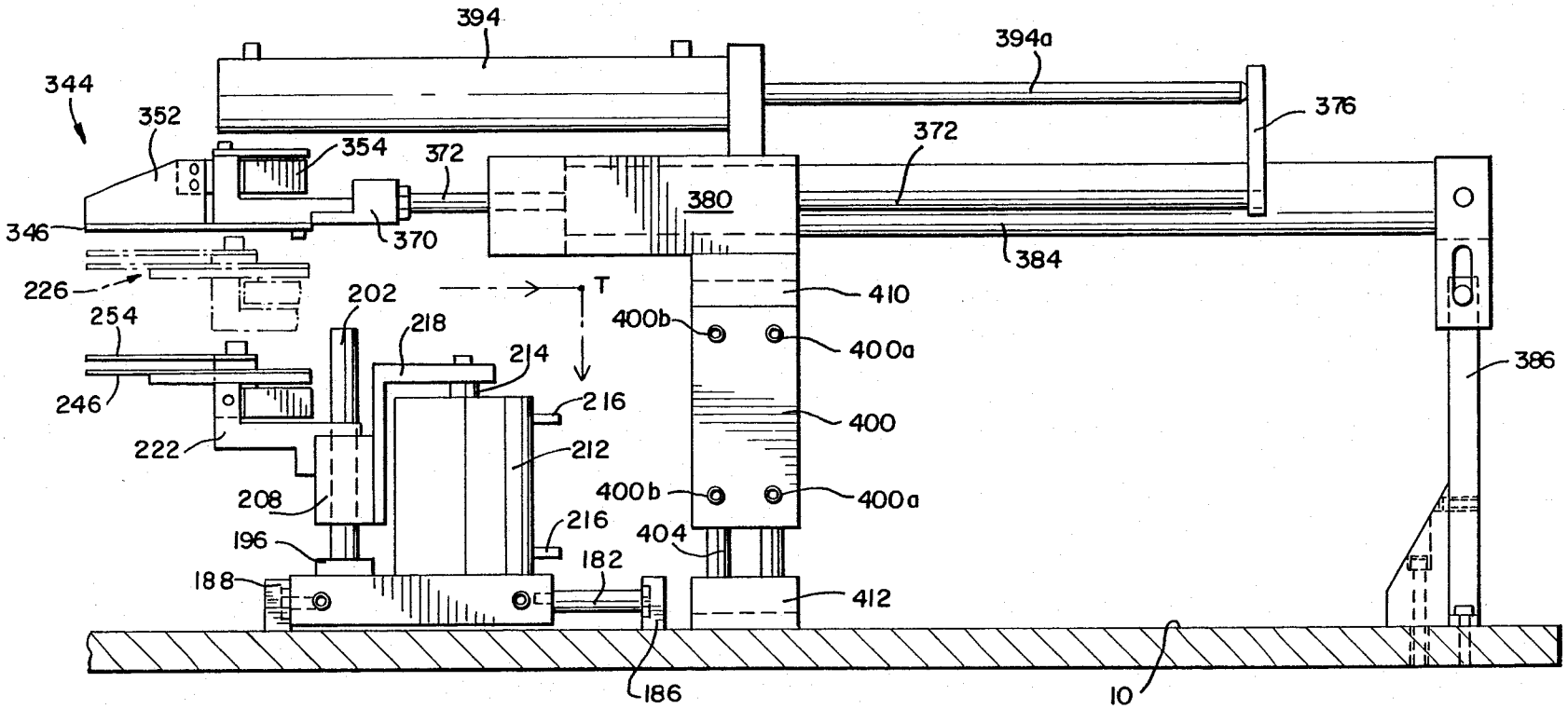
Figure 7:
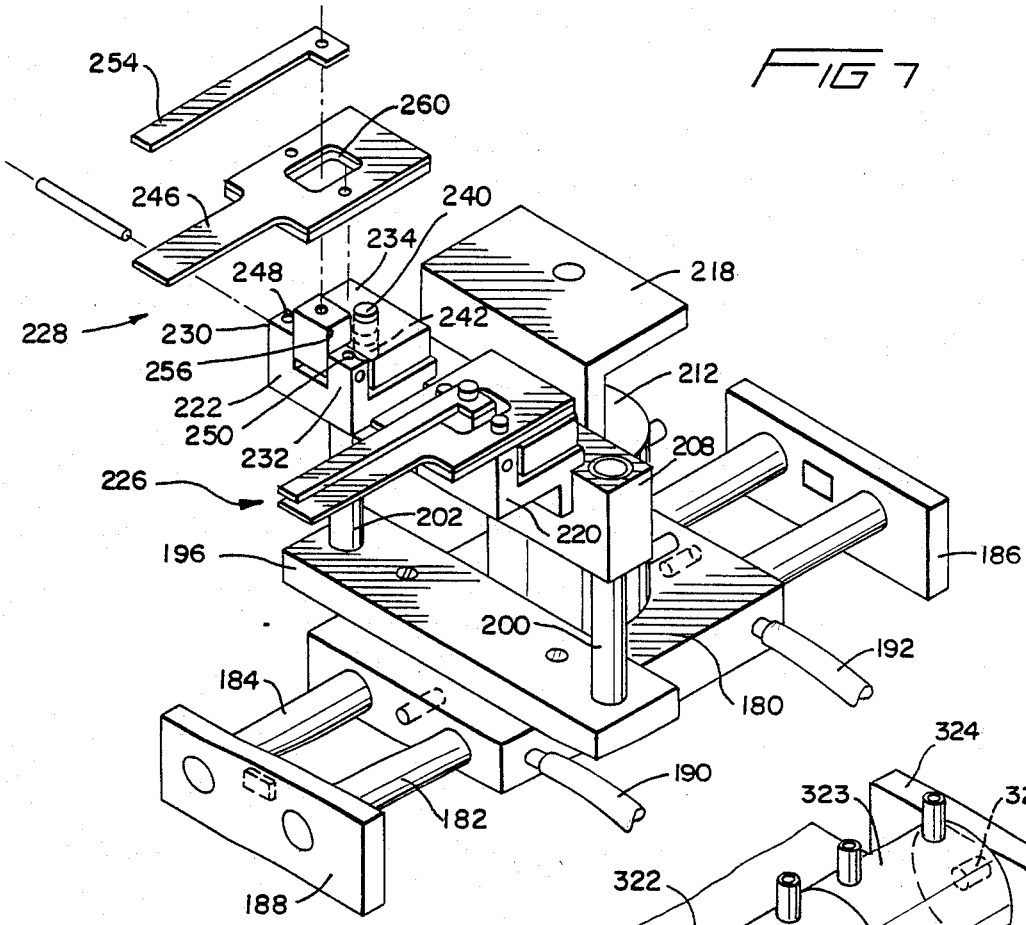
FIG. 7 is a simplified illustration of the transfer clamps assembly that is part of the apparatus of FIG. 1.

With the predetermined length of beltloop material 12 pulled out by puller jaws 120, 122, transfer clamp subassembly C is actuated to grasp the beltloop material in the following manner. The transfer clamps subassembly C is illustrated in FIGS. 2, 3 and 7 and includes a pneumatic, double acting horizontal slide 180 that is slidably mounted on rods 182, 184 that are fixed at their opposite ends to end bars 186, 188. End bars 186 and 188 are secured to base plate 10. Air hoses 190, 192 couple double-acting slide 180 to a source of air pressure that is under control of the programmed control system. A base block 196 is secured to the top surface of slide block 180 and a pair of spaced, vertical slide rods 200, 202 is secured to base block 196. A vertical slide 208 having a pair of spaced bushings therein is adapted to slide up and down on slide rods 200, 202. A pneumatic, double acting cylinder 212 is mounted on horizontal slide 180 and has a piston rod 214 that moves vertically when the cylinder is actuated. An angled bracket 218 is secured to the top of piston rod 214 and is secured along its vertical side to vertical slide 208 so that the vertical slide moves up and down with the movement of the piston rod 214.

As illustrated in FIG. 7, a pair of angled clamp mounts 220, 222 are secured by bolts, not illustrated, in spaced relationship on the top of vertical slide 208 and support respective transfer clamps 226 and 228. The exploded view of transfer clamp 228 shows that clamp mount 222 has a pair of spaced posts 230 and 232 that pivotally supports a clamp actuator 234 which includes therein a pair of spaced, independently actuated pistons 240 and 242. A bottom clamp finger 246 is secured, as by screws, to threaded holes 248, 250 in the tops of posts 230 and 232 of clamp mount 222. A top clamp finger 254 is secured to a post 256 on clamp actuator 234. It is seen that clamp actuator 234 extends through aperture 260 in bottom clamp finger 246 and that clamp actuator 234, and thus top clamp finger 254, is pivotable with respect to clamp mount 222.

When bottom piston 242 in clamp actuator 234 is actuated by the control system it moves downwardly against the adjacent surface of clamp mount 222 and raises the back portion of clamp actuator 234 so that the clamp actuator pivots about the pivot pin between posts 230 and 232. This pivoting action causes the outer end of top clamp finger 254 to move downwardly against the outer end of lower clamp finger 246, and thus closes the clamp. When top piston 240 in clamp actuator 234 is actuated by the control system it moves upwardly against the bottom surface of stationary bottom clamp finger 246 and causes clamp actuator 234 to pivot in the clockwise direction around its pivot pin. This causes top clamp finger 254 to move away from the bottom clamp finger 246, and thus opens the clamp.

During a complete cycle of operation of the apparatus of this invention the transfer clamps 226 and 228 move to four different positions. The first position is illustrated in full lines in FIG. 3. The second, a raised position, is illustrated in broken lines in FIG. 3. The third position is the raised position, but horizontal slide 180 is at it's rearmost position designated generally by "T". The fourth position is with the horizontal slide 180 in its rearmost position and the vertical slide 208 in its bottom position.

Figure 8:
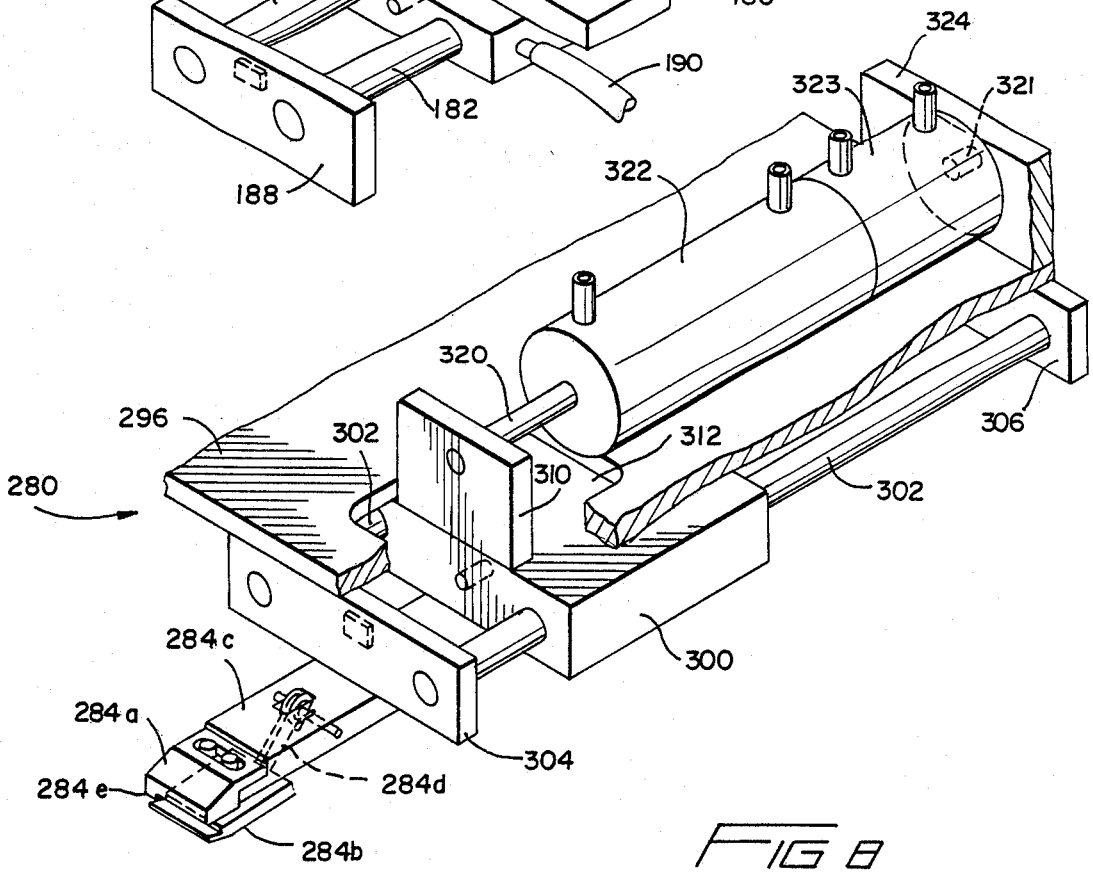
FIG. 8 is a simplified illustration of one of the loop former devices of the apparatus of FIG. 1.

The loop former subassemblies D of the apparatus of this invention is illustrated in FIGS. 1, 2, and 8. As seen in FIGS. 1 and 2, there are a pair of loop formers 280,282 above and to the sides of transfer clamps 226,228. Each loop former subassembly is supported on a respective angled bracket which is comprised of a vertical plates 290, 292 secured to base plate 10 and horizontal plates 296, 298 secured to respective ones of the vertical plates. The loop formers on the two sides includes two pairs of spring loaded open jaws 284*a*, 284*b* and 286*a*, 286*b*. Each of the top jaws 284*a*, 286*a* is secured to a respective support arm 284*c*, 286*c* and each bottom jaw is pivotally joined to its respective support arm. Springs 284*d*, 286*d* resiliently bias the open bottom jaws toward the top jaws. It is to be noted that the top and bottom jaws always are open a predetermined distance, as will become apparent from the description below.

Because the two loop formers are substantially identical, the remainder of the detailed description of their construction will refer only to the subassembly 280 illustrated in FIG. 8. Support arm 284*c* is secured to the underside of slide block 300 that freely slides on a pair of spaced, parallel slide rods 302 that are supported between end blocks 304,306. The end blocks are secured to the under side of horizontal plate 296. A vertical bracket 310 is secured to the forward edge of slide block 300 and passes through an aperture 312 in horizontal plate 296. Two back-to-back pneumatic cylinders 322 and 323 have their respective piston rods 320,321 extending from opposite ends of the two cylinders. That is, piston rod 320 of cylinder 322 extends outwardly to the left in FIG. 8 and is secured to vertical bracket 310 that extends upwardly through aperture 312. Piston rod 321 of cylinder 323 extends to the right in FIG. 8 and is secured to end plate 324 that is in turn secured to horizontal plate 296. In its normal position, pneumatic cylinder 323 has its piston rod 321 withdrawn within the cylinder so that the right end of the cylinder is closely adjacent end plate 324. In its actuated condition, piston rod 321 is extended approximately one-quarter inch. This pushes the back-to-back cylinders 323, 320 to the left in FIG. 8, and pushes vertical block 310, slide block 300, support arm 284*c*, and loop former jaws 284*a*, 284*b* to the left one-fourth inch.

In its normal position, piston rod 320 of pneumatic cylinder 322 is extended as illustrated in FIGS. 2 and 8. In its actuated position, piston rod 320 is withdrawn approximately one inch within cylinder 322 to move vertical block 310, and thus support arm 284*c* and loop former jaws 284*a*, 284*b*, one inch to the right in FIGS. 2 and 8. It thus is seen that the back-to-back cylinders 320,323 may operate in response to the programmed control system to move loop former jaws 284*a*, 284*b* between three different horizontal positions.

Figure 9:
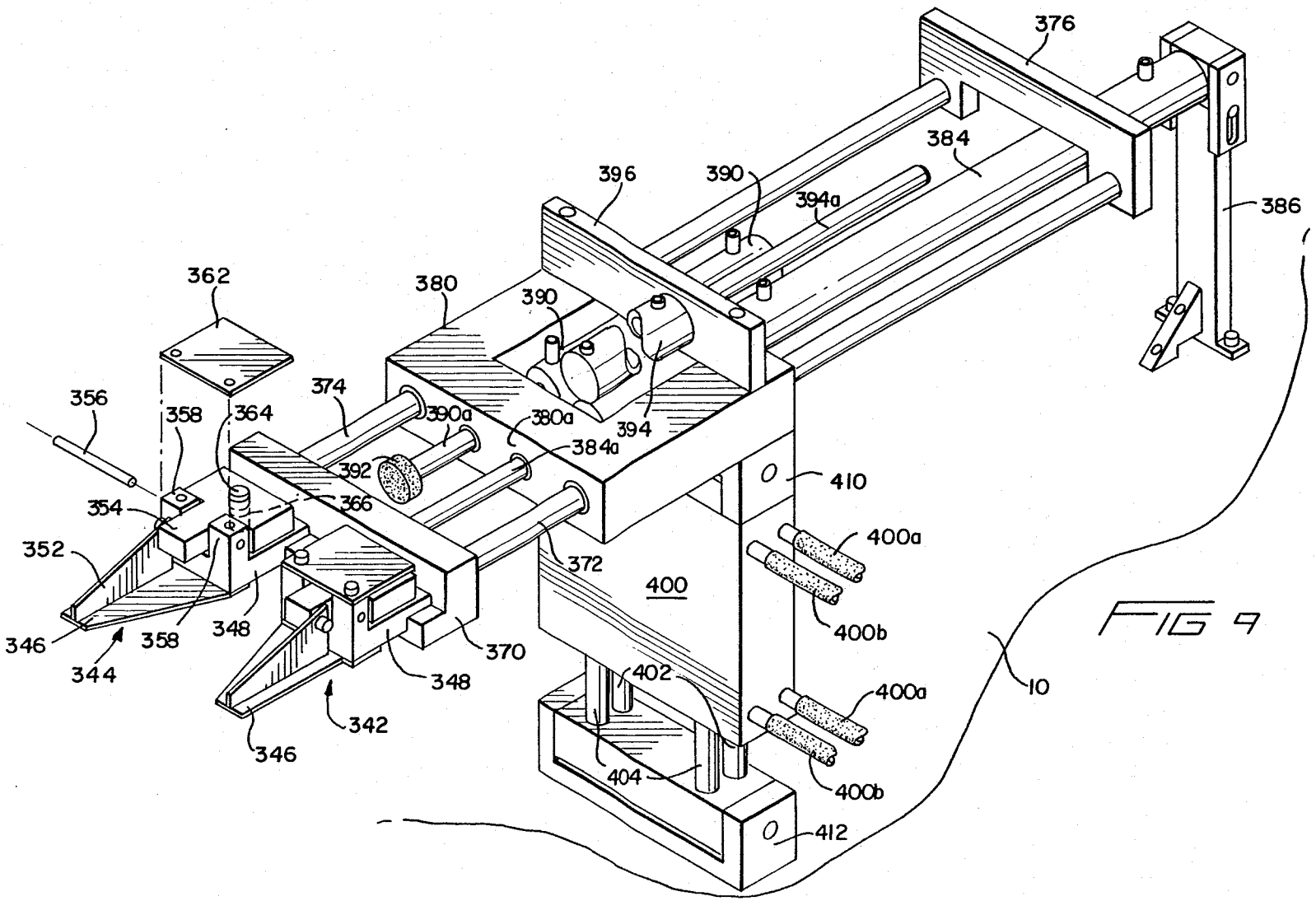
FIG. 9 is a simplified illustration of the feeder clamps assembly that receives a folded beltloop and feeds it to a sewing station.
Figure 16:
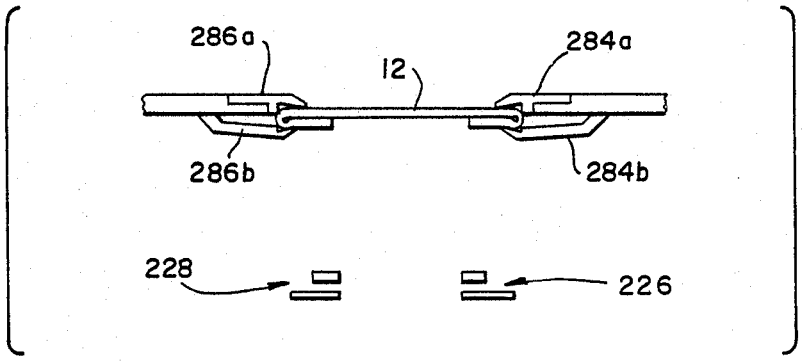

The actual operation of forming the folded-under loops on the ends of the cut piece of beltloop material will be described in detail below in the explanation of the operation of the apparatus which appears below. For the present discussion, it is assumed that a cut length of beltloop material with loops on each end is held between the two spaced loop formers 280,282, substantially as illustrated in FIG. 16. This beltloop with the ends folded under is clamped and fed to a sewing station by a pair of feeder clamps 342, 344 that are illustrated in FIGS. 1–3, and 9. Because the two feeder clamps are identical, only one will be described. As best seen in FIG. 9, a feeder clamp is comprised of a bottom clamp finger 346 that is secured to the underside of a clamp body 348, and a top clamp finger 352 that is secured to a pivotable clamp actuator 354. Clamp actuator 354 pivots on pivot pin 356 that extends between spaced, parallel posts 358 on clamp body 348. A cover plate 362 is secured to clamp actuator to pivot it with respect to clamp body 348. A cover plate 362 is secured to clamp body 348 and cooperates with pistons 364 and 366 in clamp actuator 354 to pivot the actuator with respect to clamp body 348, thereby to open and close top clamp finger 352 relative to bottom clamp finger 346. This arrangement and operation is substantially the same as that described above in connection with transfer clamps 226, 228 so will not be further described.

Clamp bodies 348 of feeder clamps 342, 344 are attached to a horizontally extending mounting bar 370 that is secured to the ends of a pair of slide rods 372, 374. As seen in FIG. 9, the right ends of slide rods 372,374 are secured to a rigid yoke member 376. The slide rods slide in respective bushings in U-shaped horizontal slide block 380. Horizontal mounting bar 370 is attached to piston rod 384*a* of pneumatic double-acting cylinder 384. As illustrated, slide block 380 is provided with a clearance hole to permit piston rod 384*a* to freely slide therethrough. Cylinder 384 is secured between a rear vertical bracket 386 and the transverse portion 380*a* of slide block 380. Bracket 386 is secured to base plate 10.

A second pneumatic double-acting cylinder 390 is attached to the transverse portion 380*a* of slide block 380, and its piston rod 390*a* extends freely through the slide block and terminates in a pusher pad 392 that is adapted to contact the back side of horizontal mounting bar 370. A third double-acting pneumatic cylinder 394 is attached to a transverse strut 396 which is secured to the rear portion of slide block 380. The piston rod 394*a* extends to the right and its free end, when extended as illustrated in FIG. 9, is positioned to contact the yoke member 376 when slide rods 372, 374 move to the left a predetermined distance which is less than the full stroke of piston rod 384*a*.

Horizontal slide block 380 and all the described apparatus associated therewith is adapted to be moved up and down between three different heights by means of a pneumatically actuated, bilateral acting, pneumatic actuator block 400. Air ports 400*a* and a pair of pistons associated therewith actuate a pair of piston rods 402 to raise and lower horizontal slide block 380 between extreme top and bottom positions. A second pair of air ports 400*b* associated with a second pair of pistons in actuator block 400 independently actuate a second pair of piston rods 404 to move horizontal slide block 380 approximately one-quarter inch.

As illustrated, both pairs of piston rods 402, 404 are attached at their top ends to a mounting bracket 410 which is secured to horizontal slide block 380. The bottom ends of the piston rods are attached to bracket 412 which is secured to the base plate 10.

With the arrangement just described, feeder clamps 342 and 344 can be moved between four horizontal positions and between three vertical positions. All of these motions are controlled by the programmable controller.

Explanation of Operation

Figure 10:
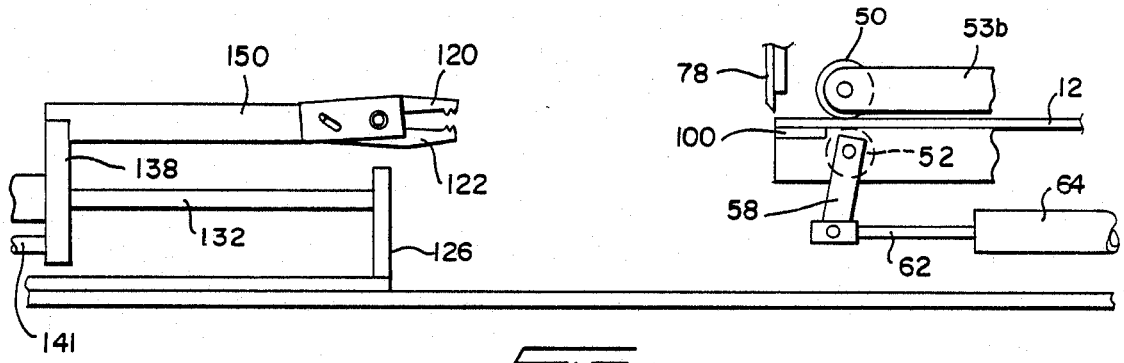
FIGS. 10–22 are simplified illustration that show the relevant apparatus and assemblies of the invention during various stages of the operation of forming a beltloop from a continuous supply of beltloop material and feeding it to a sewing station on the base of a twin-needle sewing machine.

Having described the construction of the apparatus of this invention, an explanation of its operation now will be given in connection of the simplified illustrations of FIGS. 10–22. In the initial condition illustrated in FIG. 10, it is assumed that beltloop material 12 is at the shearing edge 100 and that knife blade 78 is in its raised position. Piston rod 141 associated with puller jaws 120, 122 is withdrawn to the left so that vertical plate 138 and puller arm 150 are at their extreme withdrawn positions. In this initial condition, the transfer and feeder clamps all are closed.

Figure 11:
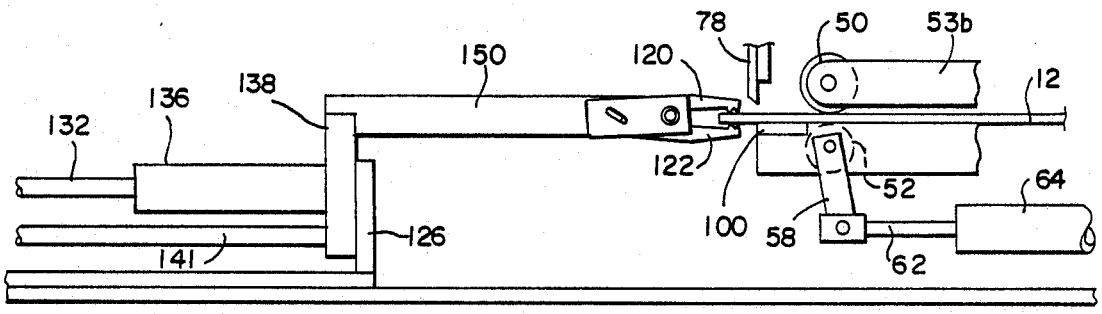
Figure 12:
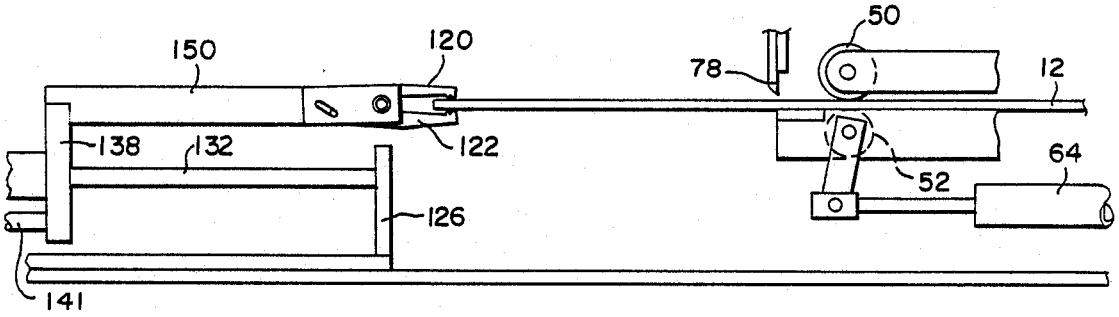

In FIG. 11, cylinder 64 is actuated to retract piston rod 62 and cause crank arm 58 to rotate in the counterclockwise direction a sufficient amount to advance beltloop material 12 approximately ⅜ inch beyond the end of shearing edge 100. Next, piston rod 141 is advanced toward the right to cause open puller jaws 120, 122 to be positioned above and below the free end of beltloop material 12. Jaws 120, 122 then close on the end of the beltloop material and piston rod 141 is retracted a predetermined distance by its pneumatic cylinder 140 so that a predetermined length of the continuous beltloop material is drawn beyond the shearing edge 100, as illustrated in FIG. 12. The one-way clutches on idler wheel 30 and driven wheel 52 permit those wheels to rotate while the beltloop material is drawn out by puller jaws 120, 122.

At this point in the operating cycle, transfer clamps 226 and 228 of FIG. 7 are at their lower and rearmost positions. The horizontal slide 180 of the transfer clamps subassembly of FIG. 7 is actuated to move the subassembly forward so that the top and bottom fingers of the open transfer clamps 226,228 extend over and under beltloop material 12. When appropriate position sensors determine that transfer clamps 226, 228 are at their proper horizontal positions, a control signal is generated to cause the fingers of the clamps to clamp onto the beltloop material 12. Puller jaws 120, 122 are caused to open, and after a delay of 2/10 second, the large cylinder 114, FIG. 4, is actuated to raise rack 108 and rotate pinion 104 to thereby cause knife blade 78 to swing downwardly and cut beltloop material 12 at shearing edge 100, FIG. 13.

Figure 14:
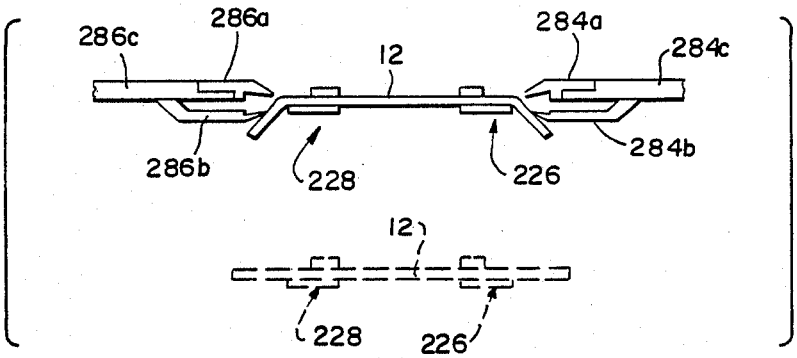

Vertical cylinder 212 of the transfer subassembly C, FIG. 7, next is actuated to raise the transfer clamps 226, 228 from their lowest position, illustrated in broken lines in FIG. 14, to their highest position which is illustrated in solid lines in FIG. 14. It is seen in FIG. 14 that as the cut beltloop approaches its upper position the free ends contact the lower jaws **284*b*, 286*b* of the two loop folders 280, 282** that are adjacent and at substantially the same height as the transfer clamps. This contact causes the free ends of the beltloop to bend downwardly.

Figure 13:
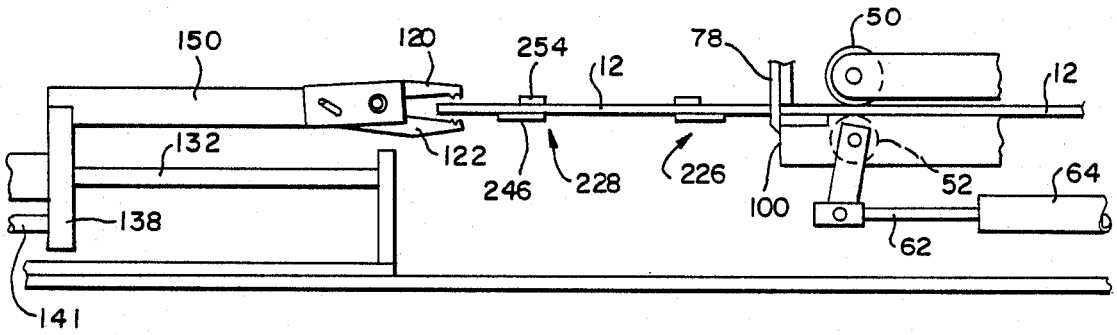

In the positions of the loop folders illustrated in FIG. 13, piston rod 321, FIG. 8, is withdrawn within cylinder 321 and piston rod 320 of cylinder 322 is extended one inch from its withdrawn position.

Figure 15:
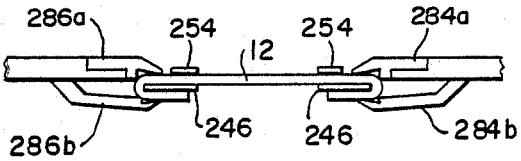

The next step is illustrated in FIG. 15 and involves both loop folders moving inwardly approximately one quarter inch so that the respective top and bottom jaws of the formers move over the outer sides of bottom fingers 246 of the transfer clamps. In so moving, the lower jaws **284*b*, 286*b* of the loop formers cause the free ends of the beltloop to fold under their respective bottom fingers 246**. It is noted that the outer tips of the top and bottom jaws of the loop formers are inclined toward the beltloop so that they hold the folded beltloop ends substantially along respective line contacts. As described above, each pair of jaws of the loop formers are spring biased against further opening so that they will resiliently clamp the looped ends of the beltloop therebetween.

When the two loop folders reach their innermost positions illustrated in FIG. 15, a signal is generated by a suitable position sensor. The control system responds to this signal to cause the top fingers 254 of the transfer clamps to pivot upwardly and release the beltloop. After a time delay of approximately 1/10 second, the horizontal slide block 180 of the transfer clamp subassembly, FIGS. 3 and 7, is actuated to move the transfer clamps to the rear so that they move from their forward position illustrated in broken lines in FIG. 3 to the rear position represented generally by the location T. Vertically acting cylinder 212 next is actuated to drop the transfer clamps to their lowest positions. They now have completed a cycle of movement. The beltloop with the folded-under ends now is held solely by the loop formers, as illustrated in FIG. 16.

Figure 17:
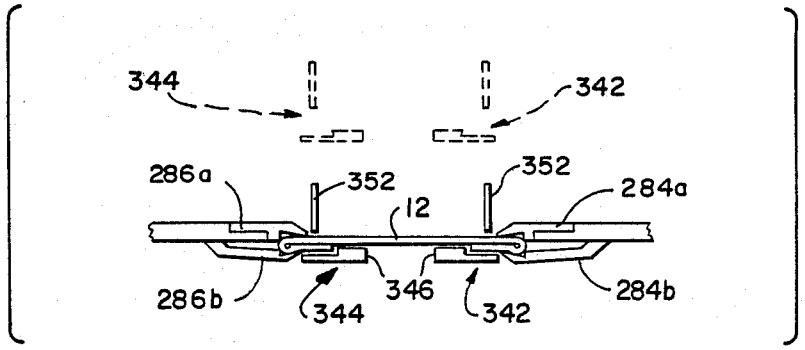

The vertical slide actuator 400 of the feeder subassembly of FIG. 9 next is actuated to lower the feeder clamps 342, 344 from their uppermost positions illustrated by broken lines in FIG. 17 to their lowermost positions. Feeder clamps 342, 344 advance horizontally from their rearmost positions to a position where the lower fingers 346 of the clamps are below the folded ends of the beltloop and the upper fingers 352 are above the beltloops, as illustrated in the solid lines in FIG. 17. It is seen that the lower fingers of the feeder clamps are shaped to accommodate the folded-under ends of the beltloop.

The feeder clamps are now in the second one of their four horizontal positions. Reference will be made to FIG. 9 for an explanation of how this position was reached from their rearmost, or most retracted position. Cylinder 390 is actuated so that it extends its piston rod **390*a* in the forward direction. Pad 392 on piston rod 390*a* engages against the rear of mounting bar 370 and pushes it and feeder clamps 342, 344 outwardly a predetermined distance so that the fingers of the feeder clamps can engage the beltloop in the manner illustrated in FIG. 17**.

Figure 18:
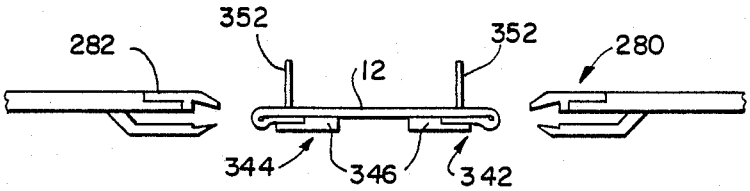

When the feeder clamp assembly E reaches this second horizontal position, a position sensor is activated and upper fingers 352 of the clamps are pivoted downwardly to securely clamp the folded-under ends of the beltloop between the top and bottom fingers of the feeder clamp. Two-tenths of a second later, the pneumatic cylinders 322 of the loop folder subassemblies 280, 280 are actuated and the folder jaws are retracted one inch away from the clamped ends of the beltloop, as illustrated in FIG. 18. The loop formers now are out of the way in anticipation of the forward movement of the feeder clamps.

At this same time in the cycle of operation, pneumatic cylinder 140 of the puller subassembly is actuated to extend puller jaws 120, 122 to the right in FIGS. 1 and 2. And, pneumatic cylinder 64 in the beltloop feeder subassembly is actuated to feed ⅜ inch of beltloop material beyond shearing edge 100, thereby to commence another operation of pulling out from the continuous supply of beltloop material another predetermined length of material. The described operations of actuating the transfer clamps so that they clamp the pulled-out length of beltloop material, and cutting the beltloop at shearing edge 100, continue in sequence on the next length of beltloop material while the feeder clamps are clamping onto the first described beltloop.

Figure 19:
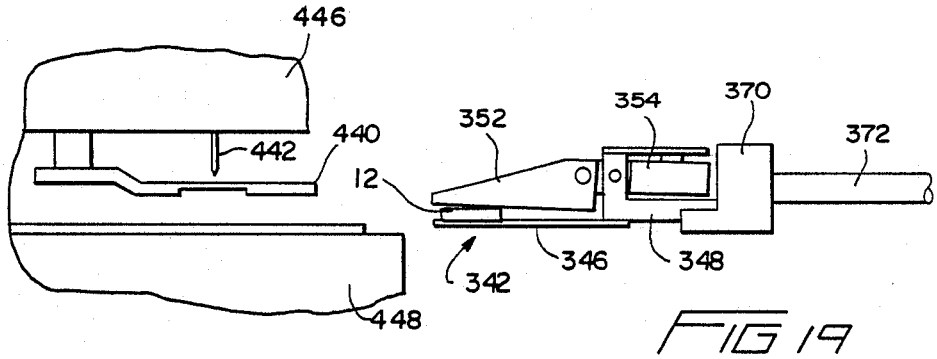

Returning to feeder clamps 342, 344 that have the first described beltloop clamped therein, the vertical actuator block 400, FIG. 9, is actuated to raise the feeder clamps to their highest positions. Both cylinders 384 and 394 are actuated to extend their respective piston rods. Piston rod 384*a* of cylinder 384 moves slide rods 372, 374 and yoke member 376 forward until yoke 376 contacts the end of extended piston rod 394*a*. This stops the forward motion of slide rods 372, 374 and yoke 376 at a position immediately in front of the sewing station where the beltloop will be stitched to the trouser waistband. This "loop ready position" is illustrated in FIG. 19. The apparatus now rests at this position until the operator actuates a button or foot switch to resume the operation and commence the stitching.

The sewing machine that is partially illustrated in FIG. 19 preferably is a twin needle machine of the type described in U.S. patent application Ser. No. 909,314, filed Sept. 19, 1986 in the name of J. Off, and which is incorporated herein by reference. As illustrated in FIG. 19, presser feet 440 and needles 442 are in their elevated positions when the feeder clamps 342, 344 are in their "loop ready positions". The upper and lower arms 446 and 448 of the sewing machine are only partially shown in FIG. 19. In this embodiment of the invention, presser feet 440 are somewhat U-shaped, i.e., they are open at their front ends that face the feeder clamps.

Figure 20:
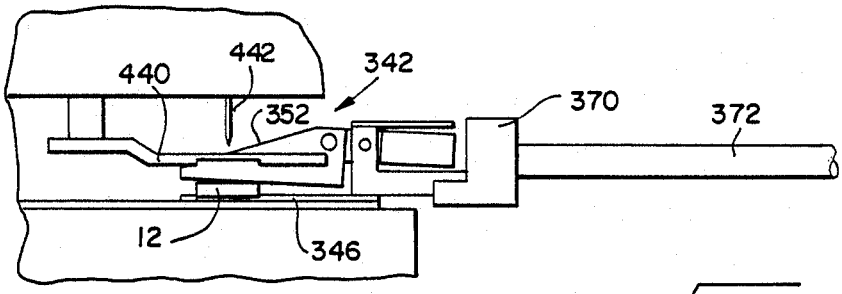
Figure 21:
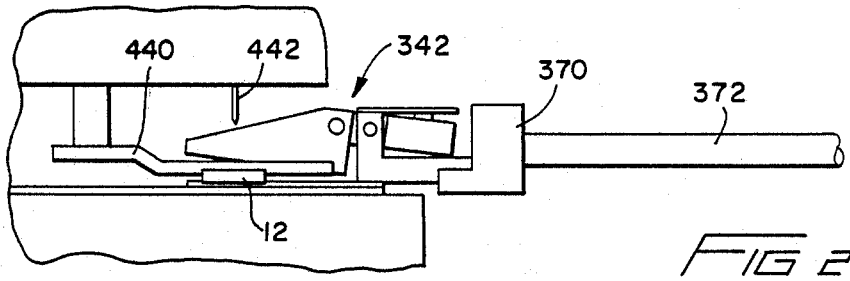
Figure 22:
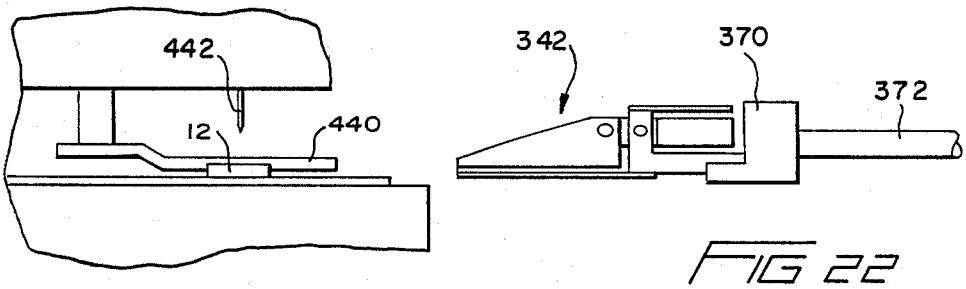

Assuming that the operator now presses a foot switch to continue the operation, pneumatic cylinder 394 is actuated to withdraw its piston rod 394*a* into the cylinder, and cylinder 384 still is actuated so that its piston rod 384*a* extends farther outwardly to move mounting block 370 and feeder clamps 342, 344 into the presser feet 440, see FIG. 20. It is seen that the top fingers 352 advance into the open front ends of the presser feet to position the beltloop 12 under needles 442 ready for stitching to the waistband of the trousers. The folded-under ends of the beltloop are directly under the two needles of the sewing machine. For simplicity of illustration, the trousers are not illustrated in the drawings of FIGS. 19–22.

When the feeder clamps are fully advanced under the raised needles, i.e., at the sewing station, a signal is produced and the control system actuates the second set of piston rods 404 associated with ports 400*b* of vertical actuator 400 to cause feeder clamps 342 and 344 to be lowered approximately ¼ inch onto the top surface of the lower arm of the sewing machine. Simultaneously, a signal is coupled to the automatic sewing machine to cause presser feet 440 to be lowered onto the beltloop to hold it firmly in position. After a delay of approximately 1/10 second, a signal is produced to cause the top fingers 352 of feeder clamps 342, 344 to open, see FIG. 21.

At the time that the operator actuated the foot switch to continue the operation on the first beltloop, the transfer clamps 226, 228 having the second length of beltloop material clamped therein is raised up to the loop folders 280,280 and the ends are folded under in the manner described in connection with FIGS. 13–16.

Resuming the explanation of the operation on the first beltloop at the sewing station, the control system next produces a signal to start the needles 442 reciprocating to form desires stitches at the folded-under ends of the beltloops. Simultaneously, cylinder 384 of the feeder clamp subassembly is actuated to retract piston rod 384*a* and cause feeder clamps 342, 344 to withdraw to their rearmost positions. Vertical slide block 400 immediately is actuated to lower the feeder clamp assembly to its lowest position. The feeder clamps then are moved forward to engage the second described beltloop from the transfer clamps 226, 228 and the operation continues as described above.

It is seen that the apparatus actually is operating on two beltloops at the same time and little time is lost between presenting successive beltloops to the sewing station.

From the above description it is seen that the apparatus forms beltloop with short folded-under ends, and that additional handling and additional apparatus are not required. All of the deficiencies noted in the prior art are overcome. The machinery is fast in operation and presents folded beltloops as fast as the operator can operate the machinery.

In its broader aspects, this invention is not limited to the specific embodiment illustrated and described. Various changes and modifications may be made without departing from the inventive principles herein disclosed.

I claim:

1. Apparatus for forming and transferring a beltloop for attachment to a waistband of a pair of trousers, comprising means for providing a desired length of beltloop material, means for engaging the desired length of beltloop material, means for engaging the desired length of beltloop material inwardly from the ends thereof in a manner to provide free ends, spaced folder means, means for establishing a wiping action between the free ends of the beltloop and said folder means to fold downwardly the free ends of the beltloop as said free ends move to positions closely adjacent the folder means, means for transferring the folder means inwardly to fold the free ends of the beltloop inwardly and under the remainder of the beltloop, and beltloop feeder means for engaging the folded-under ends of the beltloop.

2. Apparatus for forming and transferring a beltloop as claimed in claim 1 wherein the means for engaging the desired length of beltloop material includes, transfer clamp means for clamping the beltloop material inwardly of the ends of the desired length.

3. The apparatus for forming and transferring a beltloop as claimed in claim 2 wherein the means for establishing a wiping action between the free ends of the beltloop and the folder means includes, means for providing a relative motion between the transfer clamp means and the folder means to bring the free ends of the beltloop closely adjacent the folder means, whereby the free ends of the beltloop are folded downwardly by contact with the folder means.

4. The apparatus claimed in claim 3 wherein the means for providing relative motion between the transfer clamp means and folder means includes, means for providing vertical motion between the transfer clamp means and the folder means to cause the ends of the beltloop to wipe against the folder means during said vertical motion to turn the free ends of the beltloop downwardly relative to the transfer clamp means.

5. The apparatus claimed in claim 4 wherein said folder means includes a pair of spaced folder means, one adjacent each end of the beltloop that is clamped in the transfer clamp means, said apparatus further including, means for moving each of the spaced folder means inwardly against the downwardly bent free ends of the beltloop to fold the free ends of the beltloop inwardly and under the remainder of the beltloop.

6. Apparatus as claimed in claim 5 wherein the pair of spaced folder means includes two spaced jaws adjacent opposite ends of the beltloop, said apparatus further including, means for moving said spaced jaws inwardly over the downwardly bent ends of the beltloop to bend the free ends of the beltloop under the transfer clamp means.

7. Apparatus as claimed in claim 1 wherein the means for providing a desired length of beltloop material includes, means for providing said desired length of material from a substantially continuous supply of beltloop material, and knife means for severing said desired length of material from said supply of beltloop material.

8. The apparatus claimed in claim 7 wherein the means for providing said desired length of beltloop material includes, means for clamping the free end of beltloop material from said supply.

9. The apparatus as claimed in claim 5 wherein the means for providing a desired length of beltloop material includes, means for providing said desired length of material from a substantially continuous supply of beltloop material and knife means for severing said desired length of material from said supply of beltloop material.

10. The apparatus claimed in claim 9 wherein the means for providing said desired length of beltloop material includes, clamping means for clamping the free end of beltloop material from said substantially continuous supply, and means for pulling the clamp and the end of the beltloop material from said supply.

11. Apparatus for forming and transferring a beltloop for attachment to a waistband of a pair of trousers, comprising means for providing a desired length of beltloop material, means for clamping the desired length of beltloop material inwardly from the ends thereof, a pair of spaced folder members, each having a pair of jaws facing the other folder member, means for establishing relative vertical motion between the clamped length of beltloop and said pair of spaced folder members, means for translating the folder members inwardly so that the jaws of each folder member spans a downwardly folded end of the beltloop and folds the end inwardly and under the beltloop, feeder clamps for engaging the folded ends of the beltloop, and means for advancing the feeder clamps with folded-under beltloop ends toward a sewing station.

12. Apparatus for forming and transferring a beltloop for attachment to a waistband of a pair of trousers, comprising means for advancing a desired length of beltloop material from a continuous supply of such material, a pair of transfer clamps for clamping the desired length of beltloop material inwardly from the ends thereof, each said transfer clamp having a relative thin bottom member on which the beltloop is held, knife means for severing the clamped desired length of beltloop material from said supply, a pair of spaced folder members positioned above and to opposite sides of the transfer clamps, each folder member having jaws that face the other folder member, means for raising the transfer clamps upwardly to positions closely adjacent respective spaced folder member, the ends of the severed beltloop being folded downwardly by the folder means at the transfer clamps move to positions closely adjacent the respective folder members and the ends of the severed beltloop contact the folder members, means for translating the folder members inwardly so that the jaws of each folder member spans a transfer clamp and pushes an adjacent folded down free end of the beltloop under the bottom finger of the respective transfer clamp, means for releasing the engagement of the transfer clamps with the beltloop, a pair of feeder clamps for clamping the folded ends of the beltloop clamps, and means for advancing the feeder clamps with the folded beltloop ends toward a sewing station.

* * * * *